US010598364B2

(12) United States Patent
Smith et al.

(10) Patent No.: US 10,598,364 B2
(45) Date of Patent: Mar. 24, 2020

(54) ILLUMINATED BAG AND METHOD OF USE

(71) Applicants: Krystal Smith, Houston, TX (US); Christina Anderson, Houston, TX (US)

(72) Inventors: Krystal Smith, Houston, TX (US); Christina Anderson, Houston, TX (US)

( * ) Notice: Subject to any disclaimer, the term of this patent is extended or adjusted under 35 U.S.C. 154(b) by 0 days.

(21) Appl. No.: 16/161,880

(22) Filed: Oct. 16, 2018

(65) Prior Publication Data

US 2019/0113216 A1 Apr. 18, 2019

Related U.S. Application Data

(60) Provisional application No. 62/572,865, filed on Oct. 16, 2017.

(51) Int. Cl.

| | |
|---|---|
| ***A45C 15/06*** | (2006.01) |
| ***F21V 23/04*** | (2006.01) |
| ***A45C 3/06*** | (2006.01) |

(52) U.S. Cl.

CPC ..... *F21V 23/0471* (2013.01); *A45C 3/06* (2013.01); *A45C 15/06* (2013.01); *F21V 23/045* (2013.01)

(58) Field of Classification Search

CPC ..... A45C 3/06; A45C 15/06; F21V 23/045; F21V 23/0471

USPC ..... 362/154–156

See application file for complete search history.

(56) References Cited

U.S. PATENT DOCUMENTS

| | | | | |
|---|---|---|---|---|
| 3,121,452 A * | 2/1964 | Hyman | A45C 3/06 150/127 |
| 7,064,498 B2 * | 6/2006 | Dowling | A61N 5/0616 315/291 |
| 8,382,309 B1 * | 2/2013 | Johnston | A45C 15/06 362/156 |
| 2018/0037169 A1 * | 2/2018 | Dunham | B60Q 3/225 |

* cited by examiner

*Primary Examiner* — Jason M Han

(74) *Attorney, Agent, or Firm* — Eldredge Law Firm, LLC

(57) ABSTRACT

An illuminated bag system includes a bag with a body forming at least one interior compartment; an illumination system, having one or more lights secured within a bottom of the body; a power source; a control system to activate the one or more lights via power from the power source; and a sensor incorporated into the body of the bag and in communication with the control system; activation of the sensor is to activate the one or more lights to light the interior compartment of the bag.

8 Claims, 5 Drawing Sheets

ILLUMINATED BAG AND METHOD OF USE

BACKGROUND

1. Field of the Invention

The present invention relates generally to handbags, and more specifically, to an illuminated handbag system for improving visibility in a handbag via one or more lights.

2. Description of Related Art

Handbags are well known in the art and are effective means to carry personal items. For example, FIG. 1 depicts a conventional handbag 101 having a body 103 and one or more interior cavities 105. During use, the user places one or more items inside cavity 105 and retrieves at a later time for use.

One of the problems commonly associated with handbag 101 is lost items. For example, users commonly place many items inside interior cavities 105, thereby making it difficult to find a needed item efficiently.

Accordingly, although great strides have been made in the area of handbags, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
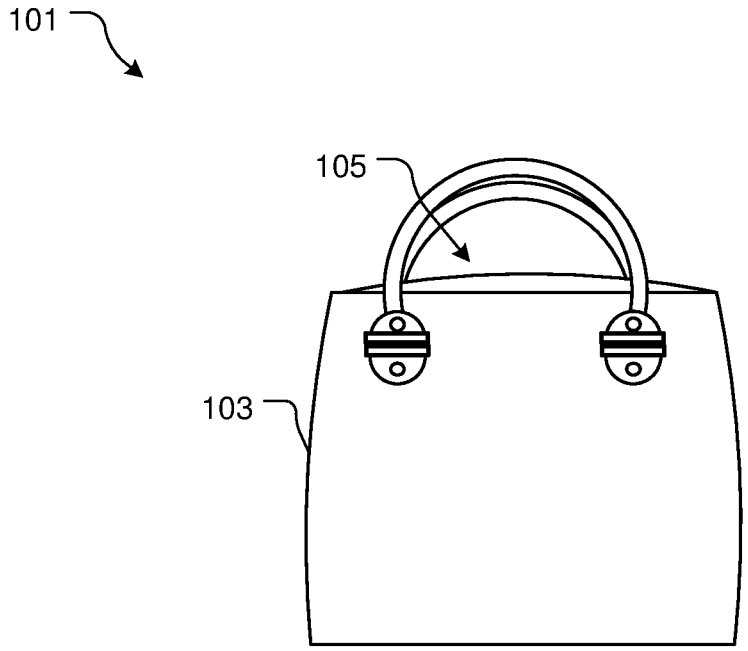
FIG. 1 (Prior Art)
FIG. 1 is a front view of a common handbag.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional handbags. Specifically, the present invention provides a means to illuminate a handbag, thereby making it easier to retrieve items from an interior of the handbag. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
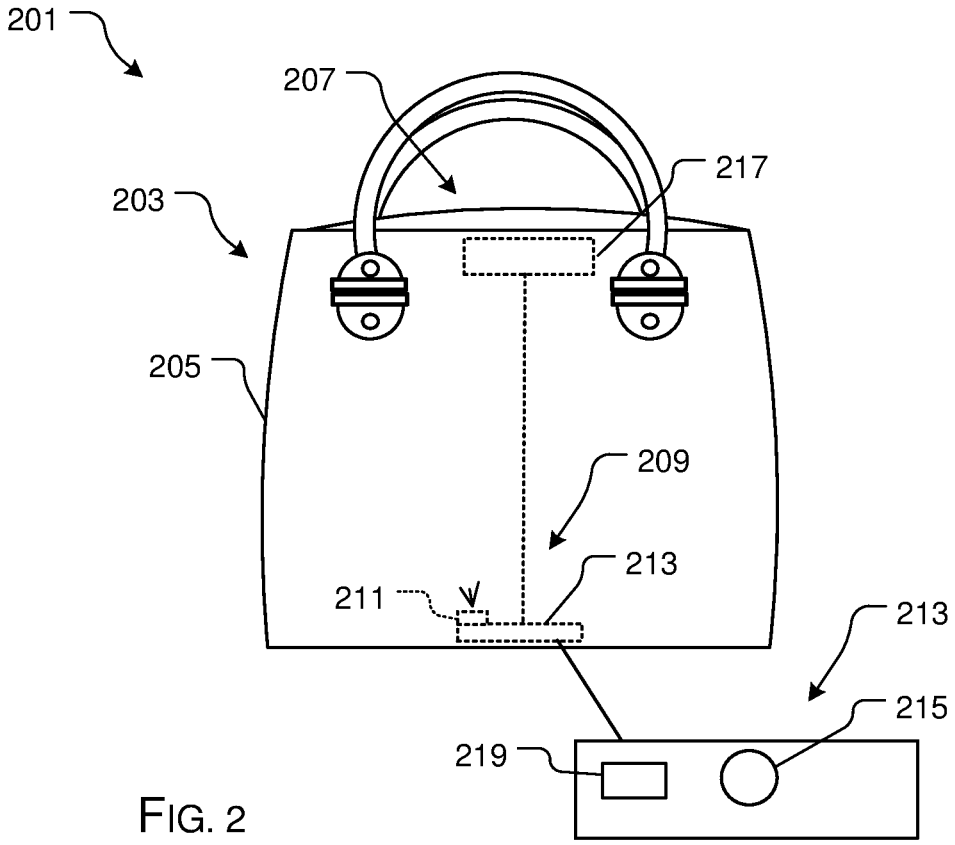
FIG. 2 is a front view of an illuminated handbag system in accordance with a preferred embodiment of the present application.

Referring now to the drawings wherein like reference characters identify corresponding or similar elements throughout the several views, FIG. 2 depicts a simplified front view of an illuminated handbag system 201 in accordance with a preferred embodiment of the present application. It will be appreciated that system 201 overcomes one or more of the above-listed problems commonly associated with conventional handbags.

In the contemplated embodiment, system 201 includes a bag 203 having a body 205 with one or more interior cavities 207. It should be appreciated that bag 203 can vary in materials, shape, size, number of compartments, and other aesthetical and functional properties. System 201 further includes an illumination system 209, having one or more lights 211 contained within cavity 207. In the preferred embodiment, lights 211 are secured within a bottom of cavity 207, thereby providing illumination from the bottom. It is contemplated and should be appreciated that lights 211 can vary in number and type, including LED lights and colored lights.

Illumination system 209 further includes a control system 213 having at least a power source 215 and in communication with one or more sensors 217. Sensors 217 are in communication with control system 213, wherein control system 213 is configured to activate one or more lights 211 based on commands from sensor 217.

As shown in the schematic of FIG. 2, control system 213 includes power source 215, which can be a replaceable battery, a rechargeable battery, or any other power source. Control system 213 can further include a timer 219, wherein control system 213 can be configured to activate light 211 for a predetermined time.

Figure 3A:
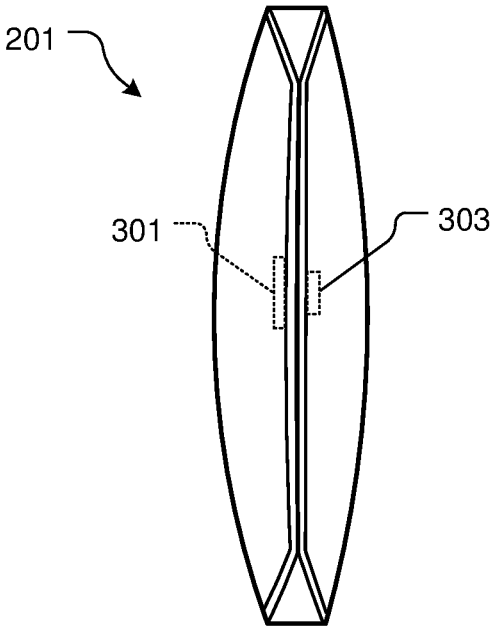
FIGS. 3A and 3B are top views of the handbag system of FIG. 2.
Figure 3B:
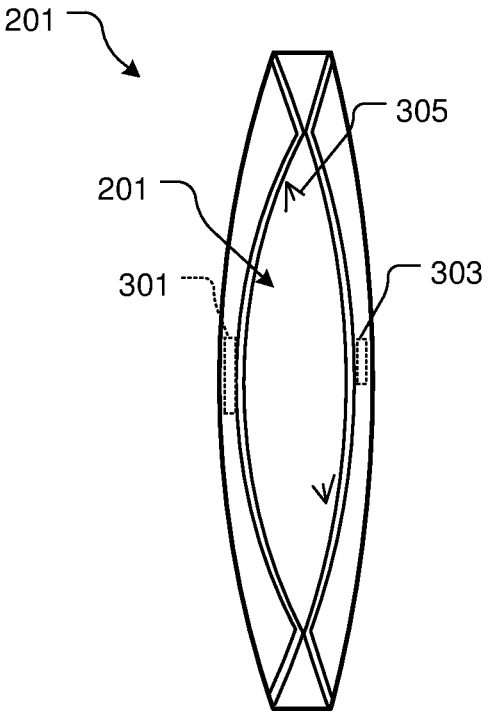

In FIGS. 3A and 3B, one exemplary embodiment of system 201 is shown with a proximity sensor 301. Proximity sensor 301 can be a capacitive proximity sensor configured to use the variation of capacitance between sensor 301 and an object 303, wherein sensor 301 is configured to sense object 303 when in a predetermined proximity. Control system 213 can therefore be configured to activate one or more lights 305, when object 303 is displaced from sensor 301. This configuration allows for bag 201 to be illuminated upon opening of the bag, as shown in FIG. 3B. It should further be understood that capacitive proximity sensor 301 can be configured to work via non-contact with a metallic or non-metallic object.

One of the unique features believed characteristic of the present application is the configuration of a sensor to control system, wherein the sensor provides a means to activate one or more lights based on the presence of the user near the handbag.

Alternative embodiments contemplate additional sensors, such as a voice activated sensor, a motion sensor, a liquid level sensor, or various other sensors.

Figure 4:
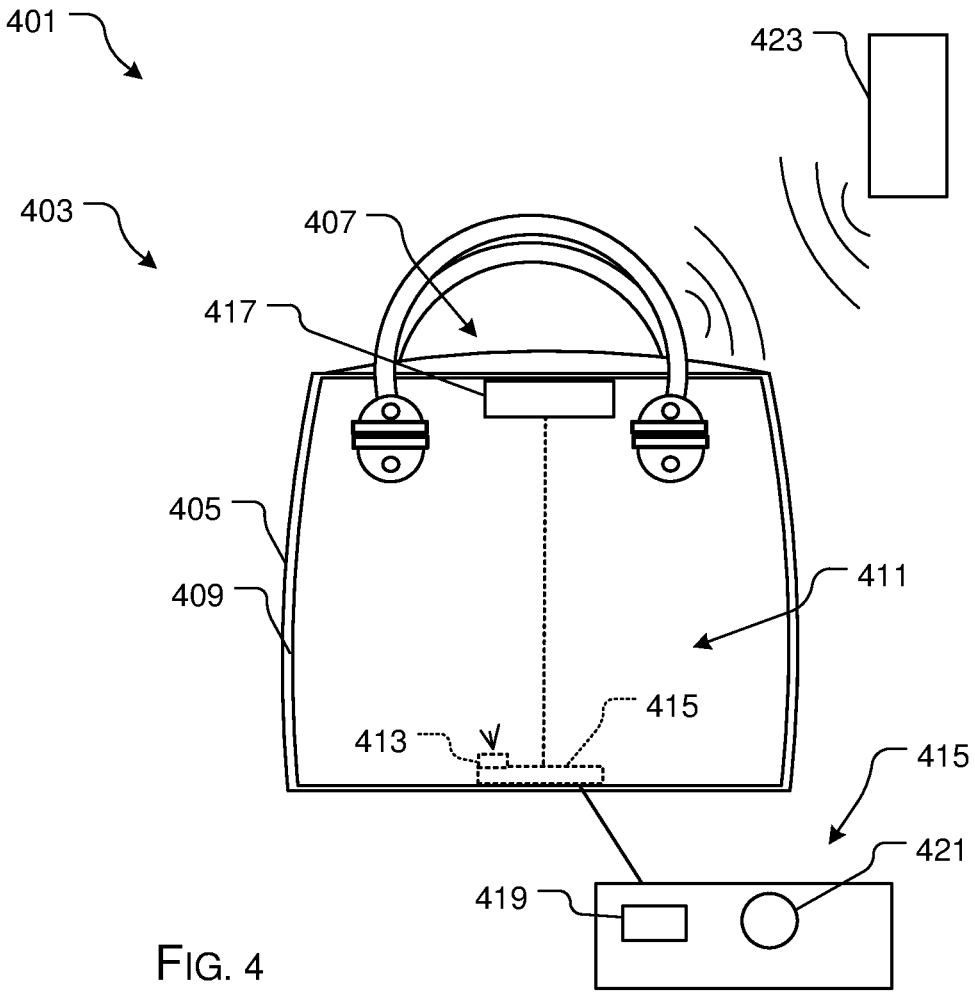
FIG. 4 is a front view of an illuminated handbag system in accordance with an alternative embodiment of the present application.

In FIG. 4, an alternative embodiment of an illuminated handbag system 401 is shown. System 401 is similar in form and function to system 201, including a bag 403 having a body 405 with one or more interior cavities 407. Bag 403 can further include one or more hard shell exterior panels 409. System 401 further includes an illumination system 411, having one or more lights 413, a control system 415, and one or more sensors 417 secured within or to the exterior of body 405. Control system 415 can further include a timer 419 and power source 421. System 401 further includes a device 423 configured to wirelessly communicate with sensor 417, wherein activation of light 413 depends on said wireless communication. It is contemplated and should be appreciated that sensor 417 and device 423 can be configured to communicate through transceivers having Bluetooth capabilities. Device 423 can therefore be an electronic device such as a mobile phone, a smart watch, a keychain, or any other similar device.

Figure 5:
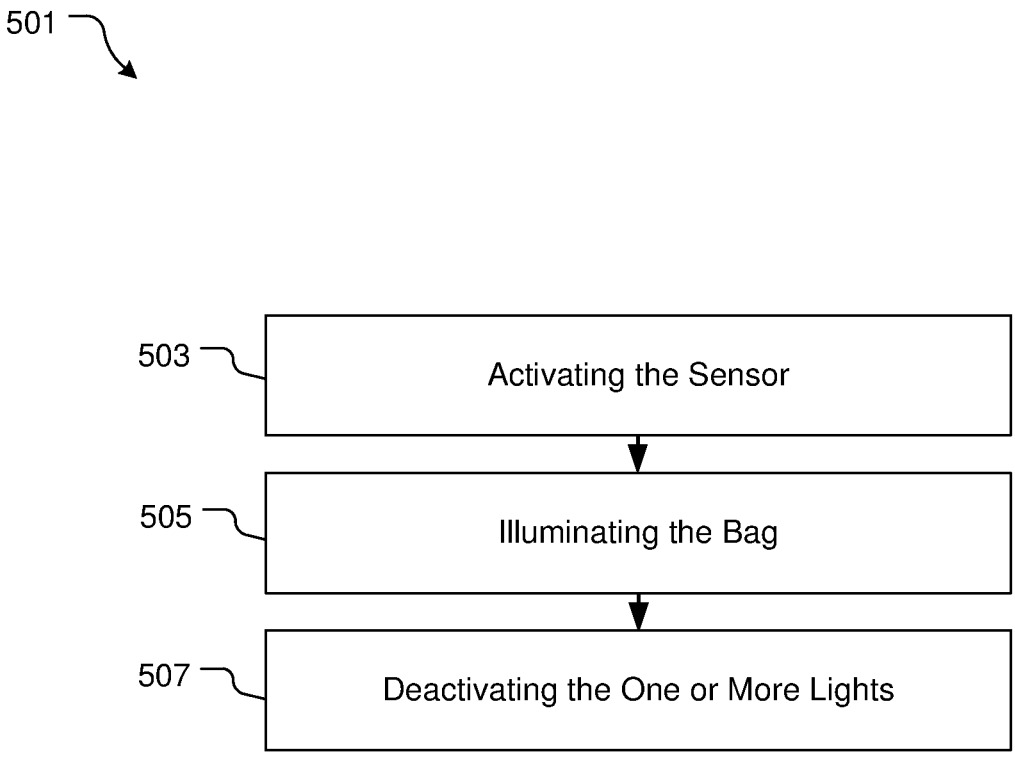
FIG. 5 is a flowchart of the method of use of the illuminated handbag systems of FIGS. 2 and 4.

In FIG. 5, a flowchart 501 depicts the method of systems 201 and 401. During use, the one or more sensors are activated based on the presence of the user, as shown with box 503. It should be understood that such activation can occur when the user reaches into the bag, or when the user approaches the bag. The activation of the one or more sensors sends a command to the control system, wherein the one or more lights are activated, thereby illuminating the bag, as shown with box 505. The one or more lights are deactivated based on a command from the control system, as shown with box 507. It should be appreciated that the control system can be configured to deactivate the one or more lights based on a predetermined time or based upon removal of the item causing activation of the sensor, such as when the user removes their hand from the interior of the bag.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An illuminated bag system, comprising:
- a bag, having:
  - a body forming an interior compartment, the body having:
    - a bottom surface; and
    - a side surface;
- an illumination device, having:
  - a housing secured to the bottom surface of the body;
  - a light secured to the housing;
  - a power source disposed within the housing;
  - a control system configured to activate the light via power from the power source; and
- a sensor secured to the side surface of the body of the bag and in communication with the control system;
- wherein activation of the sensor is configured to activate the light to light the interior compartment of the bag.

2. The illuminated bag system of claim 1, wherein the bag further comprises one or more hard panels secured to an exterior of the bag.

3. The illuminated bag system of claim 1, wherein the sensor is a proximity sensor.

4. The illuminated bag system of claim 1, wherein the sensor comprises:
- a capacitive proximity sensor positioned at an opening of the body;
- wherein the control system is configured to activate the light when the capacitive proximity sensor detects a removal of an object away from the capacitive proximity sensor.

5. The illuminated bag system of claim 1, wherein the sensor is a motion sensor secured to an exterior of the body of the bag and configured to activate the light upon detection.

6. The illuminated bag system of claim 1, wherein the sensor comprises:
- a first electronic transceiver secured within the body of the bag; and
- a second electronic transceiver configured to be carried with a user;
- wherein activation of the one or more lights occurs upon wireless communication within a pre-determined distance.

7. The illuminated bag system of claim 1, wherein the illumination device further comprises:
- a timer in communication with the light;
- wherein the time is configured to deactivate the one or more lights upon a pre-determined time.

8. A method for illuminating a bag, the method comprising:
- providing the system of claim 1;
- activating the sensor, wherein the light is activated via activation of the sensor; and
- deactivating the sensor, wherein the deactivation of the sensor deactivates the light.

* * * * *